US010178901B2

(12) United States Patent
Chan et al.

(10) Patent No.: US 10,178,901 B2
(45) Date of Patent: Jan. 15, 2019

(54) MULTIPLE TRANSACTION CARD HOLDER AND DISPENSER

(71) Applicants: Ronald Chi-Yin Chan, Coquitlam (CA); Yau Sing Hubert Sin, Coquitlam (CA); Brian Hiyin Lee, Delta (CA)

(72) Inventors: Ronald Chi-Yin Chan, Coquitlam (CA); Yau Sing Hubert Sin, Coquitlam (CA); Brian Hiyin Lee, Delta (CA)

( * ) Notice: Subject to any disclaimer, the term of this patent is extended or adjusted under 35 U.S.C. 154(b) by 0 days.

(21) Appl. No.: 15/817,892

(22) Filed: Nov. 20, 2017

(65) Prior Publication Data

US 2018/0140061 A1 May 24, 2018

Related U.S. Application Data

(60) Provisional application No. 62/423,916, filed on Nov. 18, 2016.

(51) Int. Cl.
*A45C 1/06* (2006.01)
*G07D 9/00* (2006.01)

(52) U.S. Cl.
CPC ..... *A45C 1/06* (2013.01); *G07D 9/004* (2013.01); *A45C 2001/065* (2013.01); *A45C 2001/067* (2013.01)

(58) Field of Classification Search
CPC . A45C 11/18; A45C 11/182; A45C 2001/065; A45C 2001/067; A45C 1/06; B65D 83/12; G07D 9/004
USPC ..... 206/39, 394.4, 39.5, 38, 449, 555
See application file for complete search history.

(56) References Cited

U.S. PATENT DOCUMENTS 4,305,497 A * 12/1981 Pacilio ..... G07D 1/08 206/81
4,647,118 A * 3/1987 Kamperman ..... G11B 33/04 206/308.1
4,817,253 A * 4/1989 Harmatuik ..... A45C 11/182 150/137
4,887,739 A * 12/1989 Parker ..... A45C 11/18 221/155
D324,305 S * 3/1992 Prey ..... D3/247
5,720,386 A * 2/1998 Allsop ..... G11B 23/0317 206/308.1
5,740,624 A * 4/1998 Baseley ..... A45C 11/182 40/27.5
2002/0074246 A1* 6/2002 Tiscione ..... A45C 11/182 206/39.4

(Continued)

*Primary Examiner* — Chun Cheung
*Assistant Examiner* — Brijesh V. Patel
(74) *Attorney, Agent, or Firm* — Dean A. Craine, P.S.

(57) ABSTRACT

A card holder for storing a plurality of transaction cards in a stacked alignment inside a case with a lever arm that when lifted, forces the lateral edges of the cards outward in a fan-like manner through a side opening formed on the case. The case includes a close cavity with a lower frame configured to hold a stack of transaction cards. The lower frame includes a flexible arm used to support the cards. The lever arm includes a push arm that extends into the case and positioned adjacent to the inside edges of the cards. When the lever arm is lifted, the push arm travels in an arc inside the case. Formed on the push arm are a plurality of sequentially offset steps configured to individually press against the adjacent edges of the cards causing the cards to rotate and extend in a fan-like manner through the side opening.

14 Claims, 6 Drawing Sheets

(56) References Cited

U.S. PATENT DOCUMENTS

| | | | | |
|---|---|---|---|---|
| 2005/0224149 | A1* | 10/2005 | Tiscione | A45C 11/182 150/148 |
| 2012/0067747 | A1* | 3/2012 | Van Geer | A45C 11/182 206/39 |
| 2013/0025750 | A1* | 1/2013 | Wingerter | A45C 1/02 150/149 |
| 2014/0014676 | A1* | 1/2014 | Minson | B65D 83/0829 221/226 |
| 2015/0282580 | A1* | 10/2015 | Chen | A45C 11/182 206/425 |
| 2015/0335118 | A1* | 11/2015 | Van Geer | A45C 11/182 150/147 |

* cited by examiner

MULTIPLE TRANSACTION CARD HOLDER AND DISPENSER

This utility patent application is based on and claims the filing date benefit of U.S. provisional patent application (62/423,916) filed on Nov. 18, 2016.

BACKGROUND OF THE INVENTION

1. Field of the Invention

This invention relates to devices used for carrying multiple membership club cards, identification cards, or transaction cards, in a compact, stacked configuration that selectively presents the cards so they may be easily identified in the stack and removed from the stack when desired.

2. Description of the Related Art

Personal membership cards, identification cards, credit cards, and debit cards, (collectively called 'transaction cards' hereinafter) are typically stored in a plurality of slots or pockets formed on the inside surfaces of a wallet. The slots or pockets are aligned in parallel rows on one or both leaves on the wallet. When cards are placed individually inside a slot or pocket, the top edges of the cards are offset and visible. Unfortunately, seeing only the top edge of a transaction card may not determine its identity. Also, because the pockets hold one or more transactions cards, the top transaction card in the slot or pocket prevents viewing of the lower cards. To identify the lower transaction cards in the pocket, the upper cards must be removed or repositioned in the slot or pocket.

Today, individuals sometimes must remove their transaction cards from their wallets using one hand. When the transaction cards are stored in slots or pockets in the wallets described above, identifying and removing the transaction cards from the slots or pockets with one hand is difficult.

SUMMARY OF THE INVENTION

These and other objects are met by an improved multiple transaction card holder used to store a plurality of transaction cards in a compact, stacked alignment inside a compact case and then that selectively displays the transaction cards in a 'fan-like' manner to expose the side edges and top corners of each card enabling the cards to be easily identified and easily removed from the stack.

The case includes a narrow, interior frame between a front panel and a rear flat panel. The interior frame is sufficient in height, width and depth to form a partially closed cavity between the two panels. The closed cavity is configured to hold a stack of longitudinally aligned transaction cards.

The interior frame includes a lower frame and an upper frame. Formed on a longitudinal side leg on the lower frame is an inward extending, vertical abutment surface used to keep the transaction cards stacked and longitudinally aligned inside the closed cavity. The lower frame also includes a transverse leg perpendicularly aligned to the longitudinal side leg. Formed or attached to the transverse leg is an upward extending flexible arm. During use, the stack of transaction cards is positioned longitudinally inside the closed cavity so the cards' longitudinal edges presses against the abutment surface and the lower edges of the transaction cards rests over the flexible arm. The lower frame includes an outer leg parallel to the side leg which forms a side opening on the case.

The upper frame is attached to the top edges of the front and rear panels. The upper frame forms the top surface of the case and acts to retain the stacked cards inside the closed cavity. The upper frame includes a lever pivot.

Disposed over and pivotally attached to the upper frame is an L-shaped lever arm. The lever arm includes a handle arm, a center hub and a push arm perpendicularly aligned with the handle arm. During assembly, the lever arm is aligned so the handle arm is disposed above the upper frame and the push arm extends into the case's closed cavity. The center hub receives the lever pivot formed on the upper frame to pivotally connect the lever arm to the upper frame.

The push arm extends downward into the closed cavity so its inside edge is aligned with the abutment surface on the lower frame. Formed on a transversely aligned surface on the push arm are a plurality of sequentially aligned, offset steps. The steps are arranged in an incline direction from the center hub to the push arm's distal. When the push arm is rotated, each step is configured to press against the adjacent inside edge on one of the transaction cards aligned in the stack. When the distal end of the handle arm is lifted, the steps move in arcs with different radii and force the transaction cards adjacent to the steps laterally different distances. The flexible arm on the lower frame is configured to facilitate rotation of the cards as the push arm moves in an arc causing the transaction cards to be dispensed in a fan-like manner through the side opening on the case, similar to the way a set of playing cards are held in a person's hand. When arranged in this manner, the outside longitudinal edge and upper corner of each transaction cards is exposed making it easier to identify each card and easier to remove and return the card to the stack.

DESCRIPTION OF THE PREFERRED EMBODIMENT(S)

Figure 17:
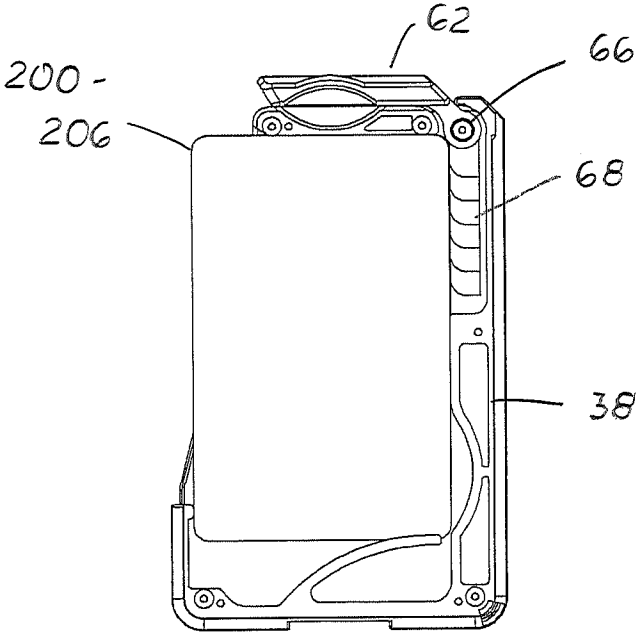
FIG. 17 is a sectional side elevational view of the multiple card holder and dispenser showing a stack of four transaction cards stored inside the case.

In the Figs., there is shown an improved multiple transaction card holder 10 disclosed used to store a plurality of transaction cards 200, 202, 204 206 (four transaction cards shown) in a compact, stacked alignment inside a case 12 as shown in FIG. 17. During use, the cards 200, 202, 204, and 206 are selectively moved inside the case 12 to that the top and lateral edges of the cards extend outward through a side opening 16 formed in the case 12 in a fan-like manner through the side opening 16. When presented in a fan-like manner, the top edge and the outer lateral edge of each transaction card are visible and exposed enabling the user to quickly identify the cards and then grasp the exposed corner or edge of desired card from the stack. The user can then easily reinsert the card into the stack.

The case 12 is a relatively thin structure that includes front flat panel 20, a rear flat panel 30 and an interior frame 40 sandwiched between the front panel 20 and the rear panel 30. The interior frame 40 includes a lower frame 38 and an upper frame 50. The lower frame 38 forms the case's side surface, the bottom surface, and the opposite short side surface. As discussed further below, the upper frame 50 is transversely aligned and affixed to the top edges of the front panel 20 and the rear panel 30 and forms the case's top surface.

Figure 18:
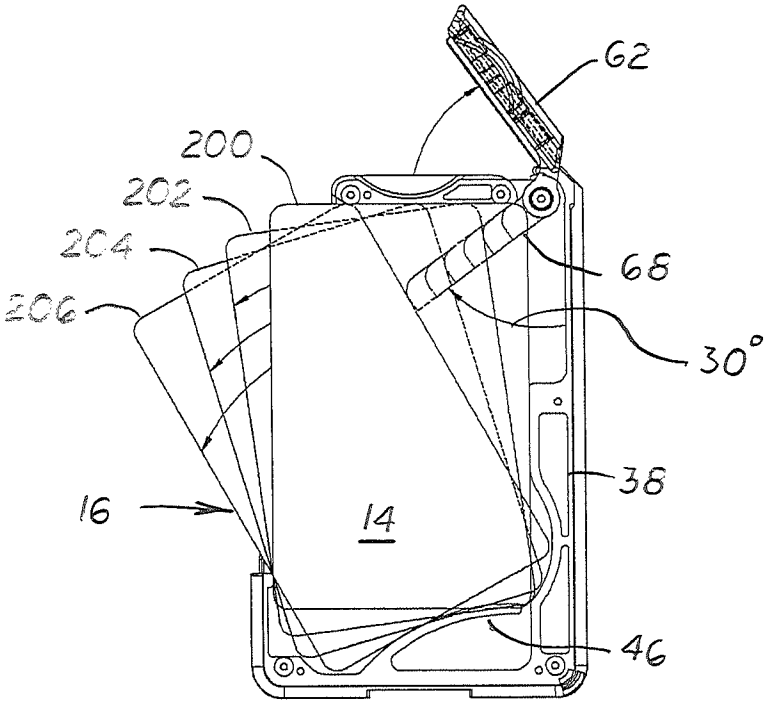
FIG. 18 is a sectional side elevational view of the multiple card holder and dispenser shown in FIG. 17 showing the lever arm pivoting upward a forcing the transaction cards outward from the case different distances.

More particularly, the lower frame 38 includes a longitudinal aligned long leg 39, a transverse leg 41, and a longitudinal aligned short leg 43. Formed on the long leg 39 near the long leg's midline axis is an abutment surface 42. The lower section of the long leg 39 is curves inward to accommodate the lower inside edges of the transaction cards 200, 202, 204, 206 as they fan outward as shown in FIG. 18. Formed on the transverse leg 41 is an inward extending flexible arm 46. The short leg 43 is perpendicularly aligned with the transverse leg 41 and parallel to the long leg 39. The length of the transverse leg 41 forms a closed cavity 14 that holds a stack of transaction cards may be positioned longitudinally inside the closed cavity 14 so the card's longitudinal edges presses against the abutment surface 42 and rests at least partially on the flexible arm 46.

The flexible arm 46 is a cantilevered structure attached or integrally formed at one end to the transverse leg 41. The flexible arm 46 includes a convex curved surface 47 that bends upward towards the long leg 39 and then flattens and extends transversely. During use, the flexible arm 46 supports part of the lower edges of the stack of cards. The flexible arm 46 is sufficiently flexible and biased to push the transaction cards when in a stacked configuration inside the closed cavity 14 to provide a snug fit against the push arm 68 discussed further below. The flexible arm 46 is also sufficiently flexible to apply a slight upward force to the stack of cards when the cards are moved laterally by a push arm 68. In the embodiment in the Figs, a void space 48 is formed under the flexible arm 46 that enables the flexible arm 46 to bend downward when the stack of cards are loaded into the case 12. Formed between the flexible arm 46 and the short leg 43 is a card receiving space 44. Together, the card receiving space 44 and the flexible arm's convex surface 47 enables the stack of cards to rotate inside the case 12 so the top edges and the lateral edges of the cards are exposed through the side opening 16.

The upper frame 50 is attached to the top edges of the front panel 20 and the rear panel 30 with screws discussed further below. The upper frame 50 retains the stacked cards inside the closed cavity 14. Disposed inside a space adjacent and above the upper frame 50 is a lever pivot 52. During assembly, the lever pivot 52 is sandwiched between the front and rear panels 20, 30, respectively, and held in a fixed position on the case 12. It should be understood that lever pivot 52 may be integrally formed on the upper frame 50.

Disposed over the upper frame 50 is an L-shaped lever arm 60 that includes a handle arm 62, a hollow center hub 66 and a push arm 68. During assembly, the lever arm 60 is aligned so the handle arm 62 is disposed above the upper frame 50 and the push arm 68 extends into the case's closed cavity 14. During assembly, the center hub 66 receives the lever pivot 52 to pivotally connect the lever arm 60 to the case 12.

Figure 1:
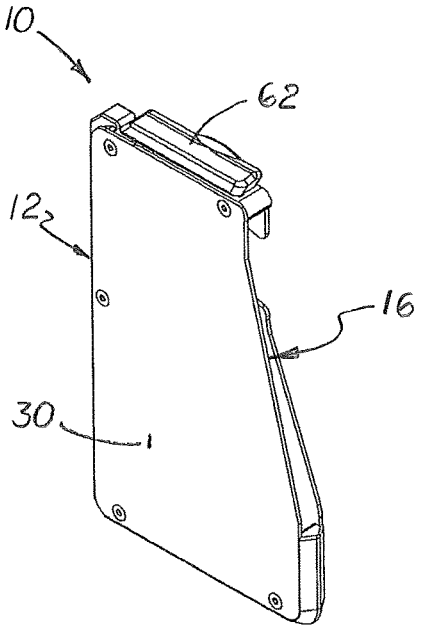
FIG. 1 is a rear perspective of a first embodiment of a multiple card holder and dispenser.
Figure 2:
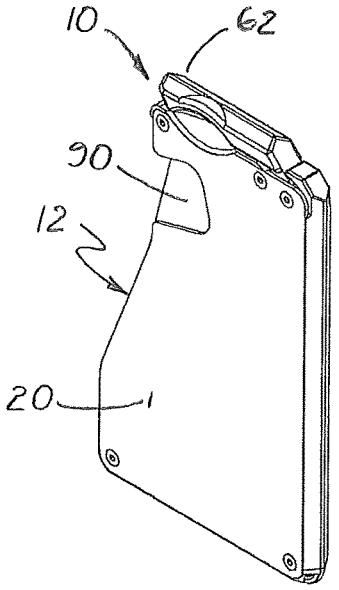
FIG. 2 is a front perspective of a first embodiment of the multiple card holder and dispenser shown in FIG. 1.
Figure 3:
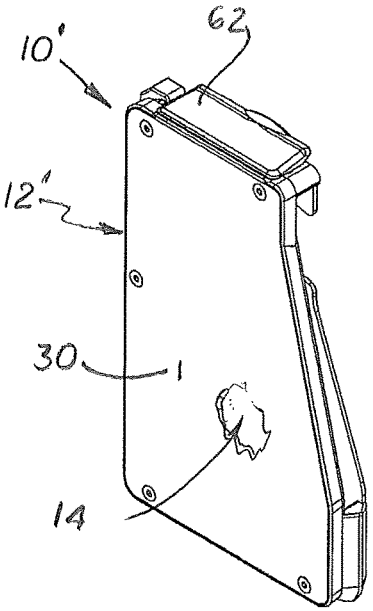
FIG. 3 is a rear perspective of a second embodiment of a multiple card holder and dispenser.
Figure 4:
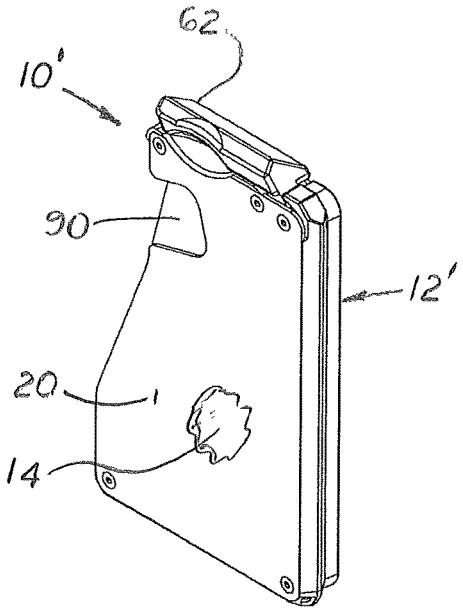
FIG. 4 is a front perspective of a second embodiment of the multiple card holder and dispenser shown in FIG. 3.
Figure 5:
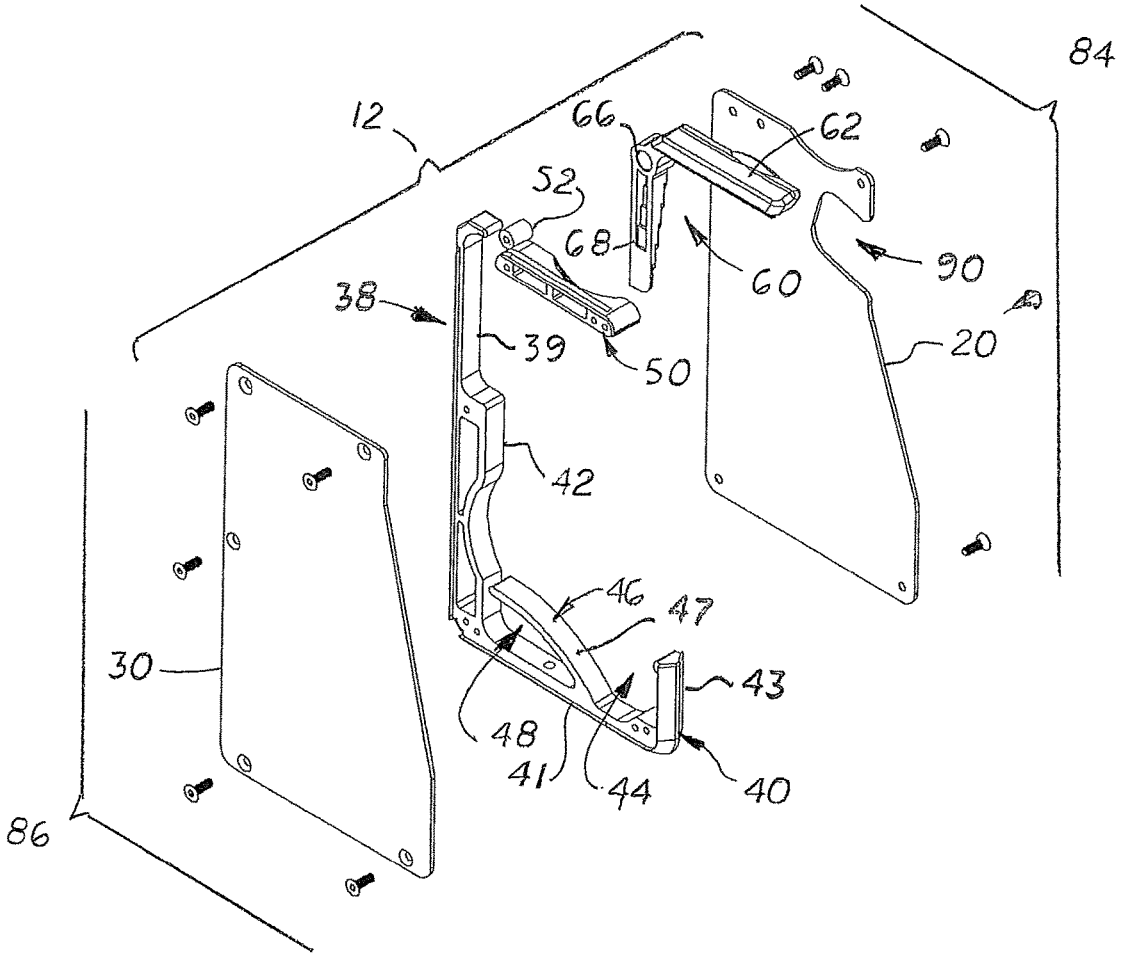
FIG. 5 is an exploded rear perspective of the first embodiment of the multiple card holder and dispenser.
Figure 6:
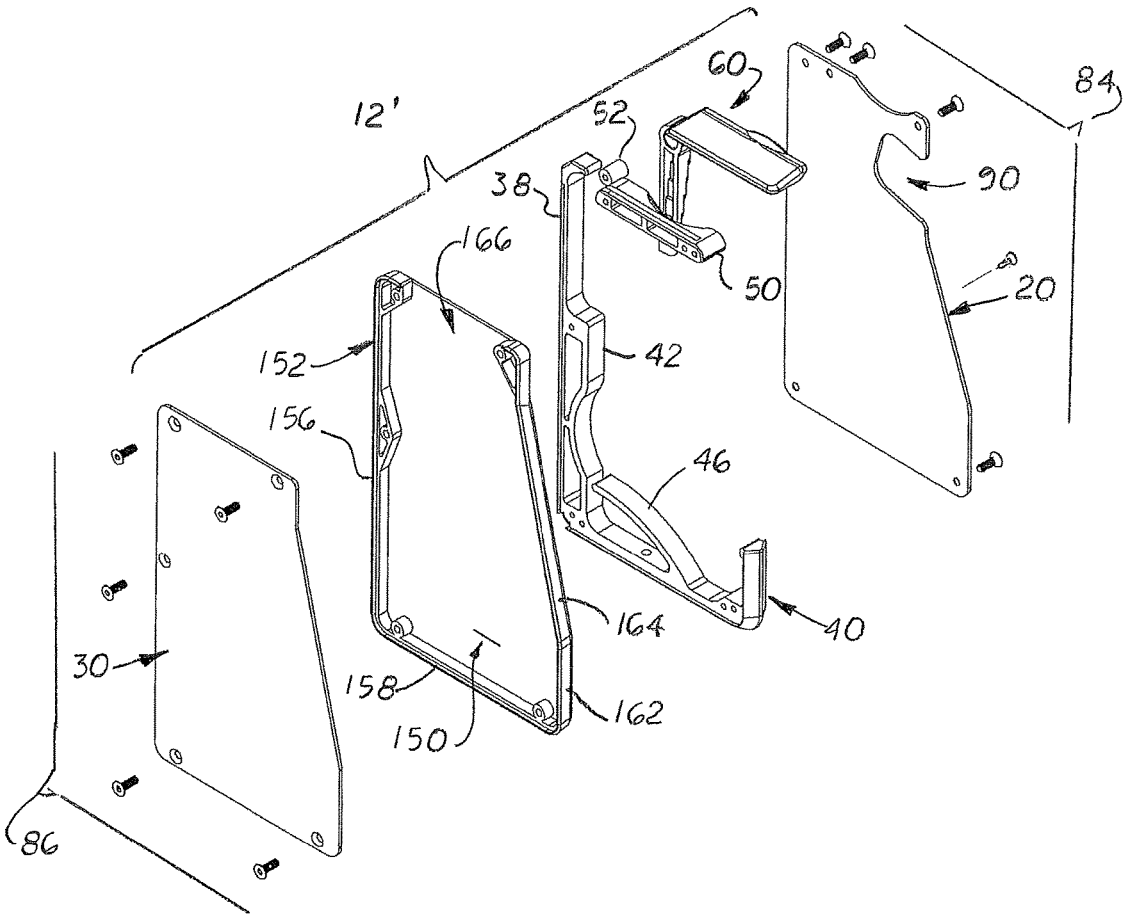
FIG. 6 is an exploded rear perspective of the second embodiment of the multiple card holder and dispenser with an enlarged case with a coin cavity.
Figure 7:
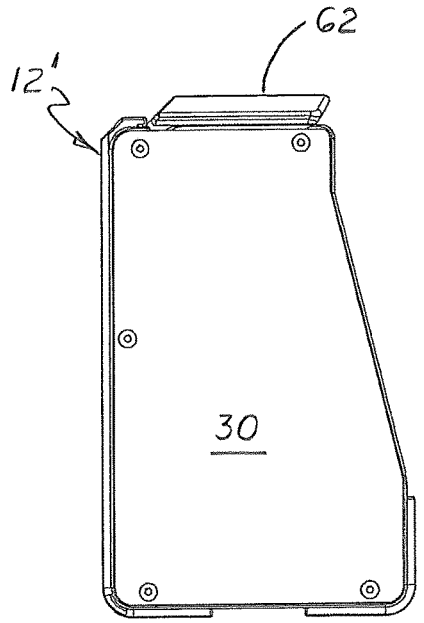
FIG. 7 is a rear elevational view of the multiple card holder and dispenser shown in FIG. 6.
Figure 8:
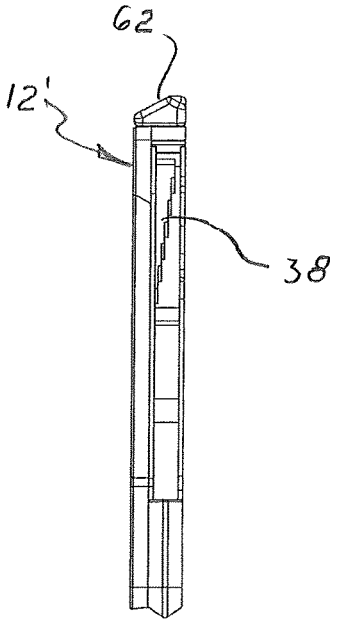
FIG. 8 is a left elevational view of the second embodiment of the multiple card holder and dispenser.
Figure 9:
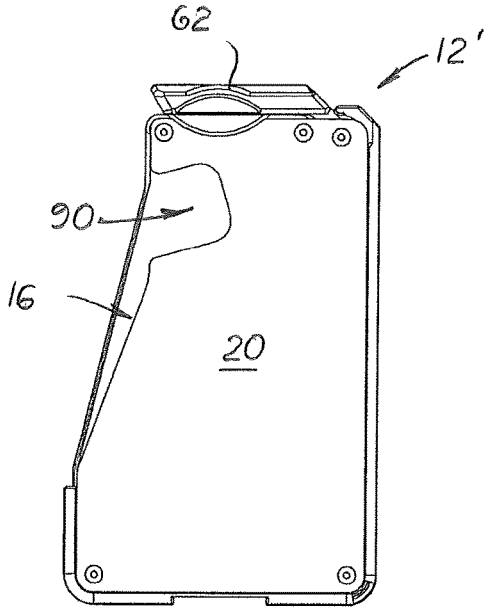
FIG. 9 is a front elevational view of the multiple card holder and dispenser shown in FIG. 6-8.
Figure 10:
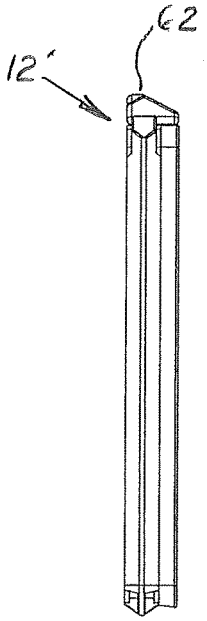
FIG. 10 is a right side elevational view of the multiple card holder and dispenser shown in FIGS. 6-8.
Figure 11:
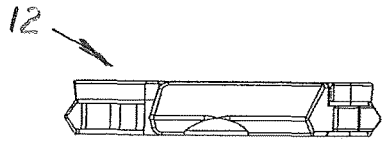
FIG. 11 is a top plan view of the multiple card holder and dispenser shown in FIG. 6-10.
Figure 12:
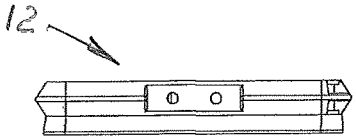
FIG. 12 is a bottom plan view of the multiple card holder and dispenser shown in FIG. 6-11.
Figure 13:
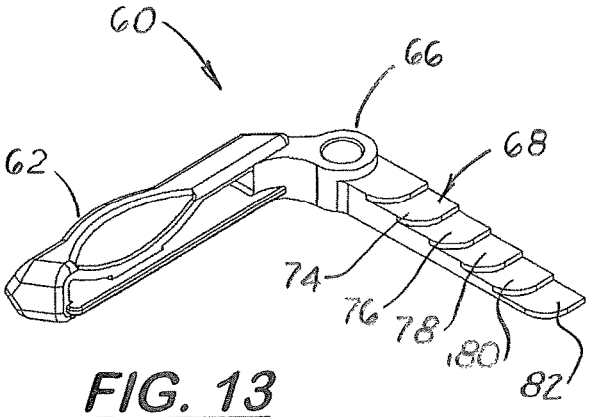
FIG. 13 is a perspective view of the lever arm.
Figure 14:
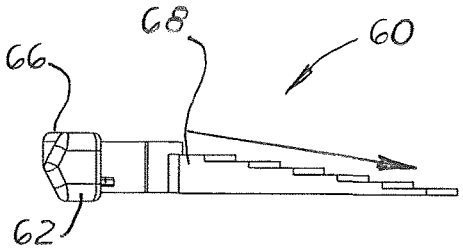
FIG. 14 is a left elevational view of the lever arm.
Figure 15:
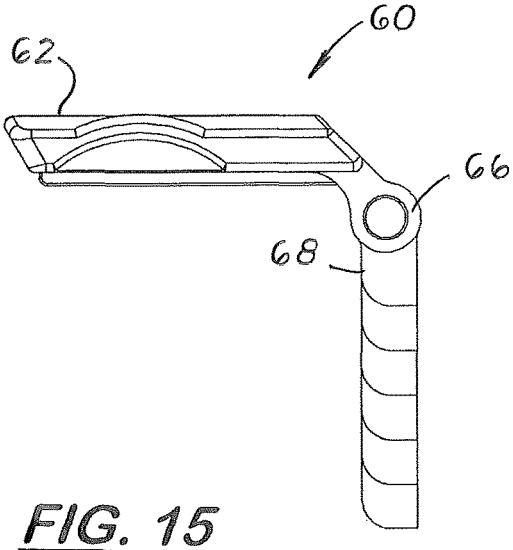
FIG. 15 is a top plan view of the lever arm.
Figure 16:
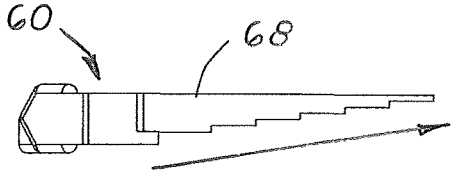
FIG. 16 is a right elevational view of the lever arm.

The push arm 68 has a thickness slightly smaller than the depth of the closed cavity 14. The rear surface (the surface adjacent to the rear panel 30) of the push arm 68 is flat so it slides freely over the inside surface of the rear panel 30. Formed on the opposite surface of the push arm 68 are a plurality of steps 74, 76, 78, 80, 82. The steps 74, 76, 78, 80, 82 are transversely aligned on the push arm 68 and configured to press individually against the adjacent edges of the transactions cards 200, 202, 204, 206 in the closed cavity 14 when the push arm 68 swings across the closed cavity 14. The number of steps formed on the push arm 68 may be adjusted to the maximum number of cards the holder carries. Because the steps 74, 76, 78, 80, and 82 moves in separate arcs with different radii, the opposite edges of the transaction cards 200, 202,204, and 206 extend in a fan-like manner from the side opening 16 on the case 12. As shown in FIG. 13, in each step 74, 76, 78, 80, and 82 may have a curved outer edge that facilitates movement of the push arm 68 against the transaction cards.

Formed on the front panel 20 is an optional, diagonally aligned finger slot 90 that enables the user to insert a finger and force the top transaction card 200 in a stacked configuration laterally through the side opening 16.

The upper portions of the side edges of front panel 20 and rear panel 30 are diagonally aligned and form a diagonal side opening 16 sufficient in size and shape to allow the lateral edges of the transactions cards 200, 202, 204 and 206 to partially extend from the case 12.

There are two sets of 5 screws a first set 84 used to attach the front panel 20 to the interior frame 40; and a second set 86 used to attach the rear panel 30 to the interior frame 40. The first set of screws 84 includes three top screws and two lower screws. One top screw extends through the front panel 20 and attached to the lever pivot 52. The two three top screws attach to two holes formed on the upper frame 50. When assembled, the upper frame 50 is held in a fixed position between the two panels 20, 30. The two lower screws on the first set 84 of screws attach to two holes formed on the lower edge of the interior frame 38.

The second set of screws 86 includes two top screws, one intermediate screw and two lower screws. One top screw extends through the rear plate 30 and attaches to the lever pivot 52. The second top screw attaches to a hole formed on the upper frame 50. The intermediate screw attaches to a hole formed on the long leg 39 near the abutment surface 42 on the lower frame 38 The two lower screws in the second set of screws attach to two holes formed on the transverse leg 41 on the lower frame 40.

In a second embodiment of the multiple card holder 10' shown in FIGS. 6-10, a coin cavity 150 is formed inside a modified, enlarged case 12' and adjacent to the closed cavity 14 that houses the transaction cards 200, 202, 204, and 206. The case 12' includes a coin plate 152 mounted between the rear panel 30 and the interior frame 40. The coin plate 152 includes four surrounding frame members 156, 158, 162 and 164 that forms the two side panels and bottom panel. The top edge of the coin plate 152 is opened forming a coin opening 166 that communicates with the coin cavity 150. The second set of screws 86 are used to attach the coin plate 152 to the interior frame 40 and the rear panel 30. The edge of the lever arm 60 is a door to close the coin cavity 150. Rotating the lever arm 60 opens the coin cavity 150 and allows coins to be dispensed from the coin cavity 150.

In the above embodiments, the card holder 10, 10' are described as holding four transaction cards 200, 202, 204 and 206. It should be understood, the card holder 10, 10' is not limited to holding four transaction cards and can be manufactured in different sizes to hold different amounts of transaction cards.

The case 12 is approximately 5 inches in length. The lower surface is approximately 2½ in length and the top surface is approximately 2 inches in length. In the card only embodiment, the case 12 is approximately ½ inches thick. In the holder 10' with the coin cavity 150, the case 12' is approximately ¾ inches thick. The diagonal side edges of the front and rear panels 20, 30, respectively, surrounding the side opening 16 are aligned approximately 12 degrees from the longitudinal axis. The side opening 16 is approximately 3 inches in length. The finger slot 90 is approximately 1 inch in length and ¾ inches in width.

The handle arm is approximately 1.5 inches in length, and the push arm is approximately 1.5 inches in length.

In the embodiment shown, the push arm 68 is perpendicularly aligned with the handle arm 62. It should be understood that the handle arm 62 and push arm 68 may be disposed at different angles if the push arm 68 is longitudinally aligned on one side of the case 12 and the handle arm 62 is located outside the case 12.

In compliance with the statute, the invention described has been described in language more or less specific as to structural features. It should be understood, however, that the invention is not limited to the specific features shown, since the means and construction shown comprises only the preferred embodiments for putting the invention into effect. The invention is therefore claimed in any of its forms or modifications within the legitimate and valid scope of the amended claims, appropriately interpreted under the doctrine of equivalents.

We claim:

1. A multiple transaction card holder, comprising:

a. a case with a top surface;

b. a card cavity formed in said case configured to hold a plurality of transaction cards aligned longitudinally and in a stacked configuration;

c. a side opening formed on said case providing access to said card cavity;

d. an interior frame located inside said case, said interior frame includes a lower frame and an upper frame, said lower frame includes a longitudinal aligned long leg and a transverse leg, and an abutment surface formed on said long leg; and e. a lever arm pivotally connected to said case, said lever arm includes a handle arm near said top surface of said case and a push arm perpendicularly aligned with said handle arm, said push arm extends into said card cavity and aligned parallel to side edges of said plurality of transaction cards when arranged in a stack configuration inside said card cavity, said push arm includes a distal end and a plurality of transversely aligned steps sequentially arranged with different thicknesses to form a downward incline plane towards said distal end of said push arm so that when said handle arm is lifted and said push arm is rotated inside said card cavity, each step of plurality of transversely aligned steps moves in a different arc and presses against a side edge of one of said plurality of said transaction cards located adjacent to each step and forces said one transaction card through said side opening and thereby displacing said plurality of transaction cards at different amounts through said side opening of said case.

2. The multiple transaction card holder, as recited in claim 1, further comprising a flexible arm formed or integrally attached to said transverse leg and located inside said card cavity, said flexible arm configured to support said plurality of transaction cards when longitudinally aligned and stacked inside said card cavity.

3. The multiple transaction card holder, as recited in claim 2, wherein said flexible arm includes a curved convex surface that enables said plurality of transaction cards to rotate when forced outward through said side opening of said case.

4. The multiple transaction card holder, as recited in claim 1, wherein said side opening on said case is diagonally aligned on one side of said case.

5. The multiple transaction card holder, as recited in claim 1, wherein said case includes a front panel with a finger slot formed thereon.

6. The multiple transaction card holder, as recited in claim 1, further including said lever arm is pivotally attached to said upper frame.

7. The multiple transaction card holder, as recited in claim 1, further including a coin cavity formed inside said card cavity and a coin opening formed on said case.

8. The multiple transaction card holder, as recited in claim 7, wherein said coin cavity is formed by a coin plate located inside said case.

9. A multiple transaction card holder, comprising:

a. a case including a front panel, a rear panel and an interior frame located between said front panel and said rear panel to form a card cavity configured to hold a stack of transaction cards, said case includes a side opening that communicates with said card cavity, said front panel and said rear panel each includes a diagonal aligned side edge surrounding said side opening; and b. a lever arm pivotally mounted on said case, said lever arm includes a handle arm and a push arm, said lever arm aligned on said case so that said handle arm extends above said case and said push arm extends into said card cavity, said push arm includes a plurality of transversely aligned steps sequentially aligned with different thicknesses, said plurality of transversely aligned steps being spaced apart on one surface of said push arm and configured to press against one transaction card in said stack of transaction cards and force part of a top edge and a lateral edge of each transaction card in said stack of transaction cards outward through said side opening at different distances.

10. The multiple transaction card holder, as recited in claim 9, further comprising a flexible arm located inside said card cavity configured to support said stack of transaction cards.

11. A multiple-card holder, comprising:

a. a case including a front panel, a rear panel and an interior frame located between said front panel and said rear panel to form a card cavity configured to hold a stack of transaction cards, said case also includes a side opening that communicates with said card cavity;

b. a lever arm pivotally mounted on said case, said lever arm includes a handle arm and a push arm, said lever arm aligned on said case so that said handle arm extends above said case and said push arm extends into the said card cavity adjacent to a side of said case opposite said side opening, said push arm includes a plurality of transversely aligned steps sequentially aligned with different thicknesses, said plurality of transversely aligned steps being spaced apart on one surface of said push arm and configured to press against each transaction card in said stack of transaction cards and force part of a top edge and a lateral edge of each transaction card in said stack of transaction cards outward at difference distances through said side opening; and c. a finger slot formed on said front panel or rear panel that communicates with said side opening.

12. A multiple transaction card holder, comprising:

a. a case including a front panel, a rear that form a card cavity configured to hold a stack of transaction cards, said case also includes a side opening that communicates with said card cavity;

b. an interior frame located inside said case, said interior frame includes a lower frame that includes a long leg, a transverse leg, and a short leg; and c. a lever arm pivotally mounted on said case, said lever arm includes a handle arm and a push arm, said lever arm aligned on said case so the handle arm extends above said case and said push arm extends into said card cavity and positioned adjacent to a side of said case opposite said side opening, said push arm includes a plurality of transversely aligned steps sequentially aligned with different thicknesses, said plurality of transversely aligned steps being spaced apart on one surface of said push arm and configured to press against each individual transaction card in said stack of transaction cards and force part of a top edge and a lateral edge of each transaction card in said stack of transaction cards outward through said side opening at different distances.

13. The multiple transaction card holder, as recited in claim 12, further comprising an upward extending flexible arm configured to support said stack of transaction cards located inside said card cavity.

14. The multiple transaction card holder, as recited in claim 12, further including an upper frame located in a fixed position inside said case, said upper frame includes a pivot that connects to said lever arm.

* * * * *